United States Patent [19]

Cawood

[11] 4,135,626

[45] Jan. 23, 1979

[54] CONSTANT FORCE SPRING EXPANDABLE CLASP-HOLDER

[76] Inventor: Robert N. Cawood, c/o Tippy Tam Inc., 1299 Rodi Rd., Turtle Creek, Pa. 15145

[21] Appl. No.: 724,342

[22] Filed: Sep. 17, 1976

[51] Int. Cl.[2] ..... A47F 7/00

[52] U.S. Cl. ..... 211/43

[58] Field of Search ..... 211/43, 51, 184, 49 D; 267/156; 108/61, 102; 242/107.2; 185/37

[56] References Cited

U.S. PATENT DOCUMENTS

| | | | |
|---|---|---|---|
| 1,395,825 | 11/1921 | Hoffman | 211/43 |
| 2,076,941 | 4/1937 | Farr | 211/43 |
| 2,284,849 | 6/1942 | Schreyer | 211/43 |
| 2,647,743 | 8/1953 | Cook | 211/43 |
| 2,670,198 | 2/1954 | Glaser et al. | 267/156 |
| 2,738,881 | 3/1956 | Michel | 211/43 X |
| 3,182,806 | 5/1965 | Lambert | 211/43 |
| 3,324,560 | 6/1967 | Snyder | 242/107.2 X |
| 3,399,782 | 9/1968 | Bascom | 211/43 |
| 3,531,060 | 9/1970 | Foster | 242/107.2 |

FOREIGN PATENT DOCUMENTS

| | | | |
|---|---|---|---|
| 295182 | 8/1928 | United Kingdom | 211/43 |
| 1238296 | 7/1971 | United Kingdom | 211/43 |
| 1339281 | 11/1973 | United Kingdom | 211/43 |
| 1358009 | 6/1974 | United Kingdom | 211/43 |

*Primary Examiner*—Roy D. Frazier
*Assistant Examiner*—Robert W. Gibson, Jr.
*Attorney, Agent, or Firm*—Buell, Blenko & Ziesenheim

[57] ABSTRACT

The specification discloses a holding device which applies a constant force to the objects held regardless of their size or number. All embodiments utilize a constant force spring which is coiled at opposite ends.

2 Claims, 8 Drawing Figures

CONSTANT FORCE SPRING EXPANDABLE CLASP-HOLDER

This invention relates to expandable clasp-holders utilizing a constant force spring.

The constant force spring is disclosed in U.S. Pat. No. 2,647,743. The disclosure suggests that the device be used "as a substitute for conventional book ends". However, when this device is used to hold objects much taller than the diameter of the spring, those objects fall over easily.

I propose the insertion of two plates between the coiled ends of the spring and the attachment of each plate to a separate base in a manner permitting the spring to pass through the plate-base joints. This will enable the device to hold higher objects without tipping.

Automatically retractable bookends are old in the art. Such devices are disclosed in U.S. Pat. Nos. 1,876,346 and 3,679,064. In U.S. Pat. No. 1,876,346 a pair of brackets are resiliently connected together by means of a spring wound around a dowel attached to one bracket with the other end clamped to the other bracket. Flexible tape is secured to one bookend and the opposite end of the tape is wound on an automatic take-up reel attached to the other bookend in U.S. Pat. No. 3,679,064. In both of these devices, the force acting upon the objects being held varies with the distance between the bookends.

I propose the use of a constant force spring to provide a constant force against the objects being held. The distance between the two bookends is irrelevant to the force applied. Hence, the user of the device cannot manipulate the bookends so as to create a force which exceeds the elastic limits of the spring. A user could accomplish this if a conventional spring is used.

An additional object of this invention is to provide a less expensive automatically retractable holder. A constant force spring of a given capacity can be made from less material than a conventional spring having the same capacity. Hence, use of the constant force spring results in material savings in the production of the holder.

I propose the use of a stop attached to the center of the spring to assure that the spring will recoil evenly on both ends. This will prevent the spring from recoiling into a single coil and, thus, releasing itself from one of the bookends. An indentation can be made in the right and left bases to accommodate the stop in a manner which will permit the apparatus to close so there is no gap between the right and left plates.

I further propose the use of restraint members attached to each end of the spring to prevent the spring from passing through the joint after it has been completely uncoiled.

Figure 1:
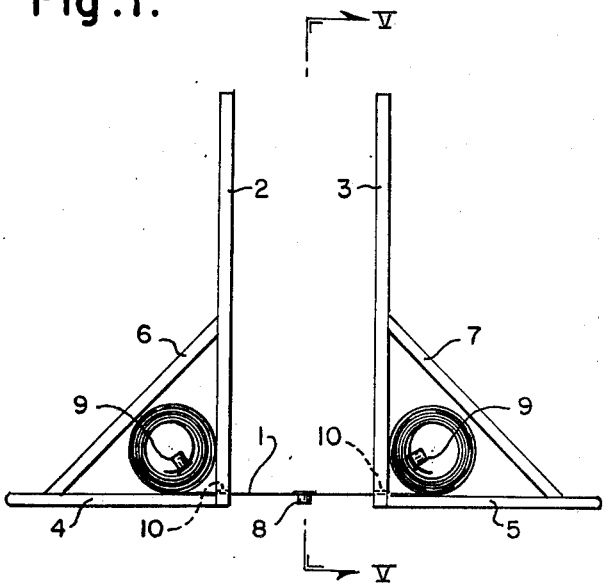
FIG. 1 is a side elevational view of a preferred form of the apparatus showing its plates in a spaced position as if one or more objects were therebetween. This preferred embodiment employs a support between each base and plate, a stop inserted in the center of the spring and a restraint member attached to each end of the spring.

Referring to FIG. 1, the preferred embodiment of the constant force spring clasp holder there shown comprises a constant force spring 1, a left plate 2 and right plate 3 interposed between the coiled ends of said spring, a left base 4 attached to the left plate in a manner allowing the spring to pass through their joint, a right base 5 similarly joined to the right plate 3, a left support 6 connected between the left plate 2 and left base 4, a right support 7 connected between the right plate 3 and right base 5, a stop 8 attached to the center of the spring 1 and restraining members 9 attached to each end of the spring 1.

Figure 2:
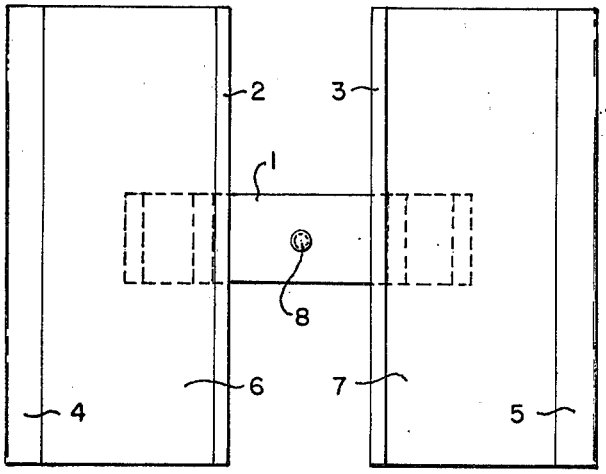
FIG. 2 is a top view of the same preferred form of the apparatus.

In FIG. 2 the same elements are shown as viewed from above the device. The constant force spring 1 has the left plate 2 and right plate 3 interposed between the coiled ends of the spring 1. These plates are attached respectively to the left base 4 and right base 5 allowing the spring 1 to pass through their joint. The left support 6 is attached between the left plate 2 and left base 4. Similarly, the right support 7 is attached between the right plate 3 and right base 5. The stop 8 is inserted into the center of the spring 1 and a restraint member 9 is attached to each end of the spring 1.

Figure 3:
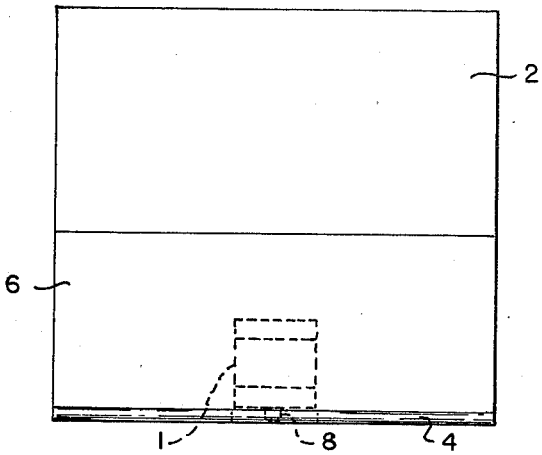
FIG. 3 is an end view of the same preferred form of the apparatus.

FIG. 3 shows the end view of the apparatus. The left plate 2 is joined to the left base 4 in a manner permitting the coiled spring 1 to pass through their joint. The left support 6 is attached between the left plate 2 and left base 4 concealing the spring 1.

Figure 4:
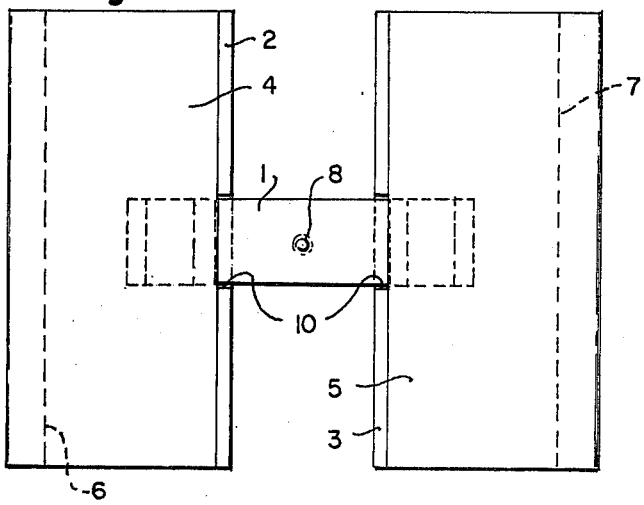
FIG. 4 is a bottom view of the same preferred form of the apparatus.

FIG. 4 is a view of the bottom of the apparatus showing the left base 4 and right base 5 which contain indentations 10 to accommodate the stop 8 inserted in the center of the constant force spring 1.

Figure 5:
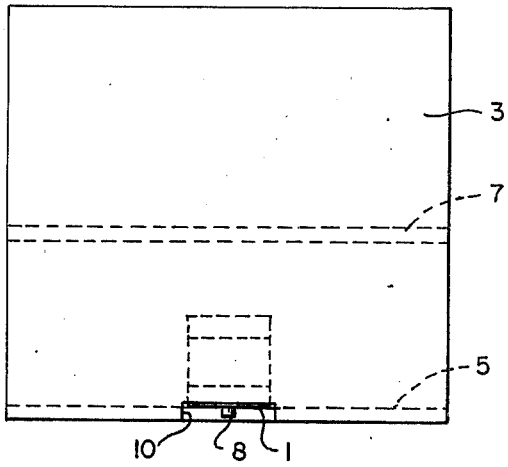
FIG. 5 is an elevational view taken along the line V—V of FIG. 1.

FIG. 5, the elevational view taken along the line V—V of FIG. 1, show the right plate 3, the right base 5 containing the indentation 10 which accommodates the stop 8 which is attached to the center of the constant force spring 1.

Figure 6:
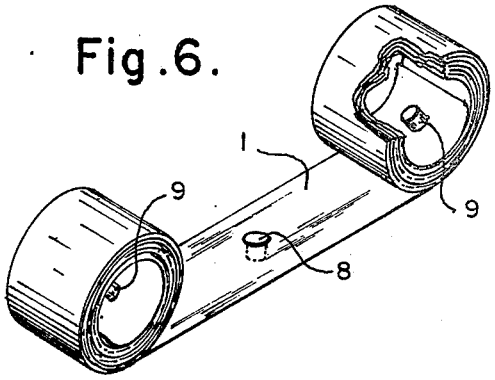
FIG. 6 is an isometric view of the constant force spring used in the preferred form of the apparatus.

FIG. 6 is an isometric view of the constant force spring 1 showing the stop 8 and the restraints 9 which are attached to the spring 1.

Figure 7:
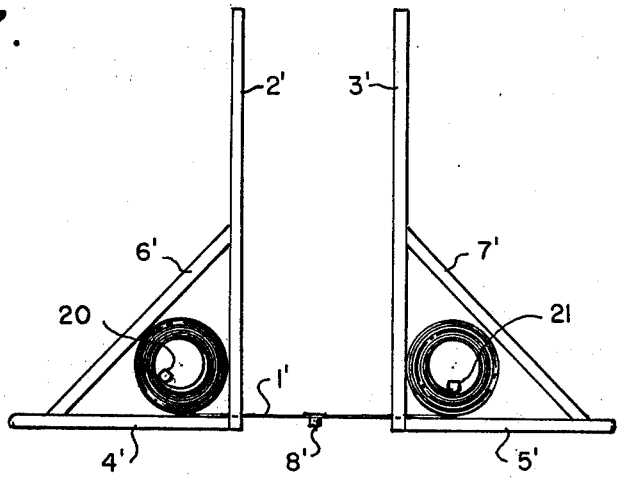
FIG. 7 is a side elevational view of a second embodiment of the apparatus of this invention.

FIG. 7 shows an embodiment similar to that of FIG. 1 in which like parts bear like numbers with the prime sign. The two figures differ in that the stop 8 is omitted and the two opposite ends of the spring 1' are bent into a box form 20 and 21 which acts as a spring from being pulled out of the end plates.

Figure 8:
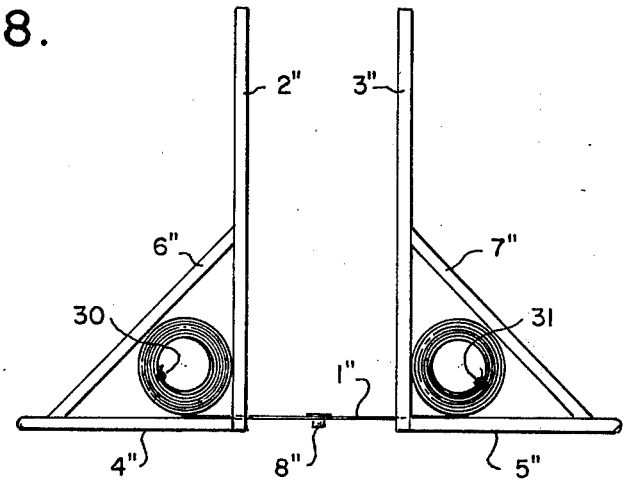
FIG. 8 is a side elevational view of a third modification of my invention.

FIG. 8 illustrates a third embodiment of my invention which corresponds generally to FIG. 1 and like parts carry like identifying numerals with a double prime sign. This modification differs from that of FIG. 1 in that the two ends of the spring 1'' are spot welded 30–31 to the adjacent spring band to form a cylinder which acts as the stop and aids in recoiling the spring as it returns.

While specific embodiments of the apparatus are here shown and described, it will be understood that variations therein are possible within the scope of the following claims.

I claim:

1. A holding device comprising a constant force spring coiled at opposite ends to form two free coils, left and right plates interposed between the coiled ends of said spring and freely movable along said spring in opposite directions from a point intermediate the opposite ends of said spring with said left and right hand plates in direct abutment with one another to a point adjacent said ends of said spring, and normally urged toward one another by said coiled ends, base means attached to each plate in a manner permitting the spring to pass through the joint between each plate and its base whereby said left and right plates are held generally in parallel relationship transverse to the portion of said spring which passes between them, a stop attached to the center of said spring and said base means containing indentations to accommodate said stop in a manner permitting said device to close with no gap between said left and right plates.

2. A holding device comprising a constant force spring coiled at opposite ends to form two free coils, left and right plates interposed between the coiled ends of said spring and freely movable along said spring in opposite directions from a point intermediate the opposite ends of said spring with said left and right hand plates in direct abutment with one another to a point adjacent said ends of said spring, and normally urged toward one another by said coiled ends, base means attached to each plate in a manner permitting the spring to pass through the joint between each plate and its base whereby said left and right plates are held generally in parallel relationship transverse to the portion of said spring which passes between them, support means attached between each plate and its corresponding base means, a stop attached to the center of said spring and said base means containing indentations to accommodate said stop in a manner permitting said device to close with no gap between said left and right plates.

* * * * *